US005520388A

United States Patent [19]

Osborn

[11] Patent Number: 5,520,388

[45] Date of Patent: May 28, 1996

[54] SINGLE-SHAPE VARIABLY ASSEMBLABLE FIGURATIVE TILES FOR GAMES, PUZZLES, AND FOR CONVERING SURFACES

[76] Inventor: John A. L. Osborn, 250 Donegal Way, Martinez, Calif. 94553

[21] Appl. No.: 385,270

[22] Filed: May 16, 1995

[51] Int. Cl.[6] ..... B44C 1/28

[52] U.S. Cl. ..... 273/157 R; 428/16; 428/44; 428/47; 428/49; 428/51; 428/80

[58] Field of Search ..... 428/44, 49, 47, 428/51, 80, 16; D25/149, 158–162; 404/42; 52/311.2; 273/157 R

[56] References Cited

U.S. PATENT DOCUMENTS

| | | | |
|---|---|---|---|
| 4,133,152 | 1/1979 | Penrose | 428/47 |
| 4,350,341 | 9/1982 | Wallace | 428/47 |

OTHER PUBLICATIONS

"Escher and The Visual Representation of Mathematical Ideas" in *M. C. Escher: Art and Science,* by R. Penrose, H.S.M. Coxeter et al. eds. North–Holland, Dec. 1986.

*Primary Examiner*—Alexander S. Thomas

[57] ABSTRACT

Single-member sets of zoomorphic tiles, in which any single tile, if duplicated, can tile the plane in periodic ways, or, with duplicates of its mirror image, in either periodic or non periodic ways, and which can also form tilings of the plane in conjunction with duplicates of any other appropriately sized but differently shaped embodiment or embodiments of the invention. The diverse and variable arrangements show vertices at which 3, 4, 5, and 6 tiles meet. These tiles, tilings, patches and rosettes of tiles may be used in puzzles, games and other recreations, for teaching certain aspects of geometry, for various purposes in conjunction with computers, for the decoration of fabrics or other surfaces, for the shape of food items such as cookies, or for other uses to which tiles or tilings may be put.

1 Claim, 4 Drawing Sheets

SINGLE-SHAPE VARIABLY ASSEMBLABLE FIGURATIVE TILES FOR GAMES, PUZZLES, AND FOR CONVERING SURFACES

BACKGROUND

1. Field of the Invention

This invention relates to the field of tiles and tilings. The field includes the familiar floor and kitchen-counter top tiles and tilings and their like, but also extends to the sometimes more abstract areas of art, design, and mathematics.

2. Some Definitions

I have adapted a few of the notions and definitions of the mathematics of patterns and tilings as follows. A tile is a two-dimensional closed shape which fits together edge-to-edge with other similar or different two-dimensional shapes, as do jig-saw puzzle pieces or bricks, to cover a flat surface of indefinite extent. Such a covering is called a tiling if it has no gap between tiles nor any overlap of one tile on another. Adding thickness to a two-dimensional tile will make it a three-dimensional object which is also called a tile. A tile is said to tile the plane if indefinitely large numbers of duplicates of the tile can fit together without gap or lap to form a tiling. The term the plane refers to the flat and indefinitely extensive plane of Euclidian geometry.

A figurative tile is one whose shape is the recognizable outline, or figure, of a person or an animal. A figurative tiling is a tiling composed of such figurative tiles. A variably assemblable tile is a tile shaped so that duplicates of it will fit together with one another in a variety of different ways, allowing a plurality of different tilings to be made.

A line or figure is point symmetric if a half-turn makes the line or figure coincide with itself. Line symmetry, or reflective symmetry, is the specifically 2-dimensional version of the more inclusive term bilateral symmetry, in which one half of a line or figure is the mirror image of the other half.

An amphographic line is a line which is used in more than one location in forming the outline of a figurative tile. Each side of an amphographic line draws, or gives positive form to, a different part of the outline of the figurative tile, so that, for example, a curve in the line which at one point is a bulge on the figure's outline, at another point is a depression. In devising a figurative tile, amphographic lines are used to connect the vertices of an ancestral straight-line geometric figure of a sort chosen so that the completed figurative outline, when replicated, and perhaps reflected to form mirror images, can tile the plane. An ancestral geometric figure can be thought of as an underlying invisible geometric determiner of vertex locations.

The tile shapes comprised in this invention are called Ozbirds tiles or are referred to simply as tiles, or Ozbirds.

3. Prior Art

Other than in my own work, there is no prior example of single-shape figurative tiles which are variably assemblable into tilings of the plane.

4. Objects and Advantages

It is an object of the invention to provide a puzzle piece, duplicates of which are capable of fitting together with one-another in a variety of ways, and with which various tiling tasks of puzzle-like sorts can be accomplished. It is also an object of the invention to provide a decorative figurative tile shape which can form varied tilings for use on any surface where they are desired such as paper, plastic, woven fabric, architectural surfaces and pavings, or can be used in various ways in conjunction with a computer or a computer program, or can be used to give amusing shape to manipulable food items such as cookies.

BRIEF DESCRIPTIONS OF THE DRAWINGS

Description of invention:

FIGS. 1A, 1B, and 1C show the derivation of the preferred embodiment from an equilateral triangle.

DESCRIPTION OF THE INVENTION

My invention comprises the shapes which I refer to herein as Ozbird tiles. A single Ozbird tile will, if duplicated, tile the plane periodically, and in conjunction with its mirror images can tile the plane in an unlimited number of non-periodic tilings.

Ozbird tiles are derived from equilateral triangles. The derivation of the preferred Ozbird embodiment is shown in FIGS. 1A, 1B, and 1C.

Figure 1A:
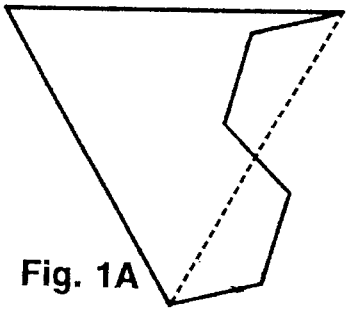

FIG. 1A shows an ancestral equilateral triangle with one side replaced by a S-shaped, or sigmoid, arrangement of five straight line segments of equal length joined end-to-end at angles of 120 degrees so as to be point symmetric around the center-point, (labeled C), of the triangle's side. This arrangement of straight lines is invariant throughout all Ozbird embodiments, and is a major factor in their being able to be assembled in different ways.

Figure 1B:
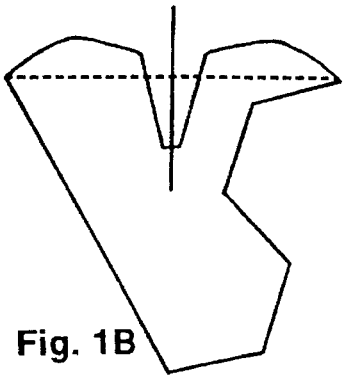

FIG. 1B shows the modified ancestral triangle of FIG. 1A further modified by having a second side judiciously modified so as to be line symmetric across the second side's perpendicular bisector which is labeled P in the drawing, each half-side being the mirror image of the other half-side.

Figure 1C:
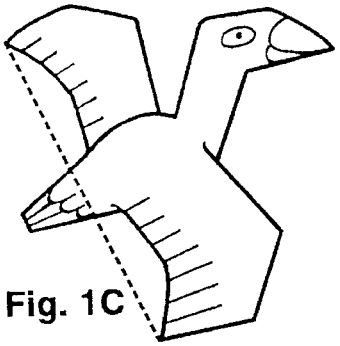

FIG. 1C shows the pattern of the second side rotated in the plane around the vertex labeled V so as to replace the third side of the ancestral triangle. The pattern of the second and third sides is amphographically devised so as to form, in conjunction with the first side, an acceptably recognizable figurative tile. It is also devised so that the second and third sides do not interfere with one another nor with the modified first side either by touching at a point or by crossing. Altogether, the above-described geometric restrictions leave little latitude for art, but imaginative internal drawing can help, as is shown by the internal drawing here in FIG. 1C.

Figure 2A:
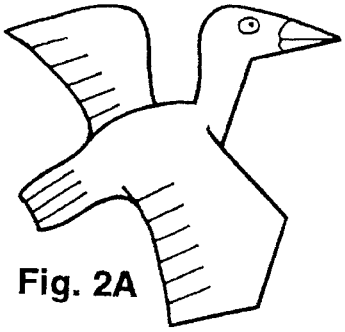
FIGS. 2A and 2B show two alternative embodiments of the invention.

FIG. 2A shows an embodiment which emphasizes the angularity of the sigmoid first side.

Figure 2B:
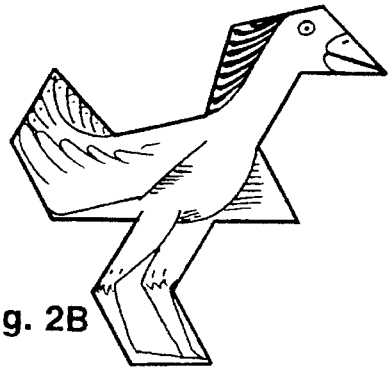

FIG. 2B shows an entirely straight-sided and sharp-angled embodiment: a "Roadrunner Ozbird" shape, also enhanced by internal drawing. See also FIG. 4.

Puzzle pieces in the shape of the preferred embodiment, (and possibly other embodiments too), might benefit from an interlocking arrangement or device to make assemblies of pieces less subject to disarrangement by inadvertent jostling.

To accomplish this, the tail-tip of each Ozbird tile could be very slightly flared, and the matching portion of each wing-body-neck notch be correspondingly enlarged to receive the flared tail-tip. A strong interlock would not be needed, and the pieces should be capable of being slid together on a flat surface and clicking into place easily by virtue of elastic deformation of the tile material. A small slit in the end of the tail might enable this when less elastic materials are used.

OPERATION OF THE INVENTION

Figure 3A:
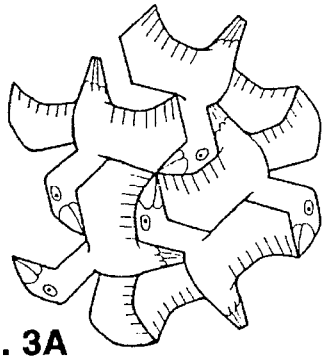
FIGS. 3A and 3B show two rosettes in which 5 tiles meet at a vertex.
Figure 3B:
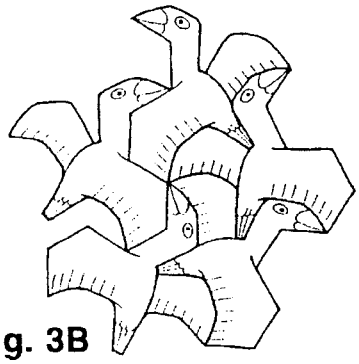

FIGS. 3A and 3B show two vertex arrangements at which five Ozbird tiles meet. Notice that on one tile in each arrangement a vertex occurs on the sigmoid side, in effect converting that tile to a quadrilateral. Various other vertices at which 3, 4, or 6 tiles meet may be seen in FIGS. 4, 5, 6, 7, and 8.

Figure 4A:
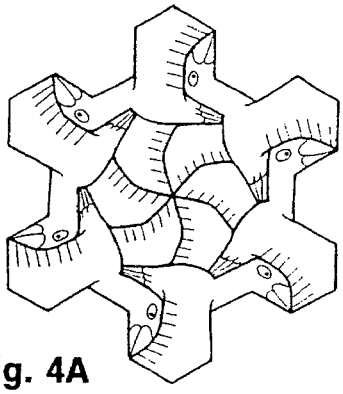
FIGS. 4A and 4B show "snowflake" rosettes of two different Ozbird embodiments.
Figure 4B:
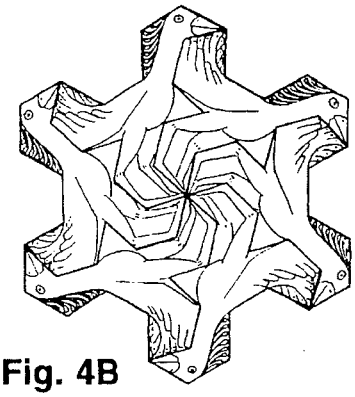

FIGS. 4A and 4B show two snowflake-like patterns of six Ozbird tiles each. Notice that the two snowflake shapes are identical despite being composed of Ozbird tiles having different shapes, as well as different internal drawing. Any patch of Ozbird tiles that is delimited entirely by the straight line segments of the component tiles' sigmoid sides, and can be surrounded by its own sort of Ozbird tiles without gap or lap, can also be surrounded by Ozbird tiles of any different sort without gap or overlap. For example, the Ozbird embodiments shown in FIGS. 2A and 2B can tile the plane in conjunction with the preferred embodiment.

Figure 5:
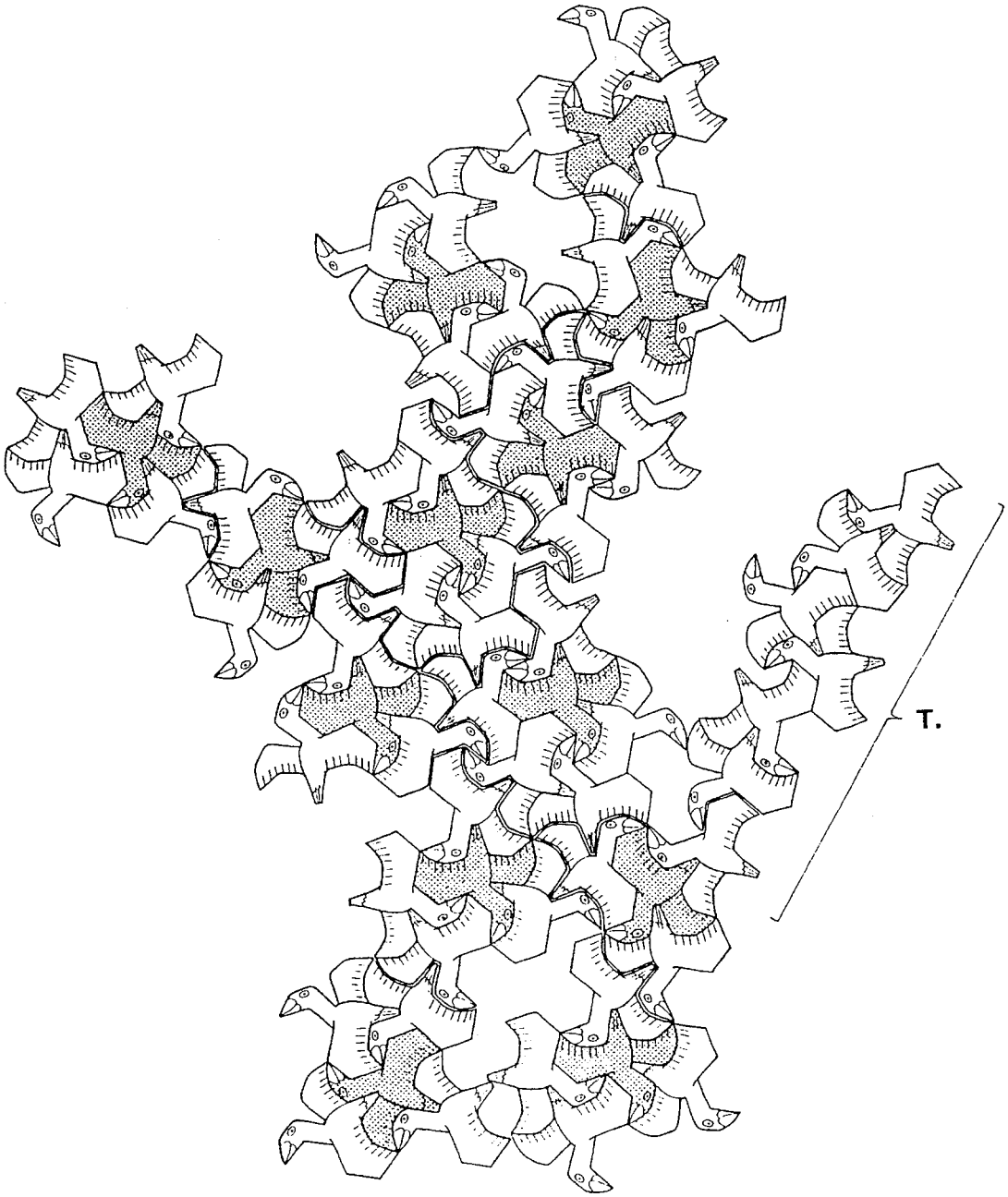
FIG. 5 shows 13 different ways to surround an Ozbird.

FIG. 5 shows 13 distinct groups of Ozbird tiles. In each group there is a central Ozbird tile, shown stippled, which is surrounded by other Ozbird tiles, and each surrounding arrangement is different from all the others. In this context, "surround" means to juxtapose tiles to all sides without gap or overlap, but not necessarily to fill all vertices. FIG. 5 can also illustrate a simple Ozbird puzzle: If only the overall, or outermost, outline is presented, an amusing Rampant-Lion effect, (enhanced by the tail T), invites filling with Ozbirds tiles. This puzzle will have more than one solution unless the positions and orientations of the tiles marked and are specified.

Figure 6:
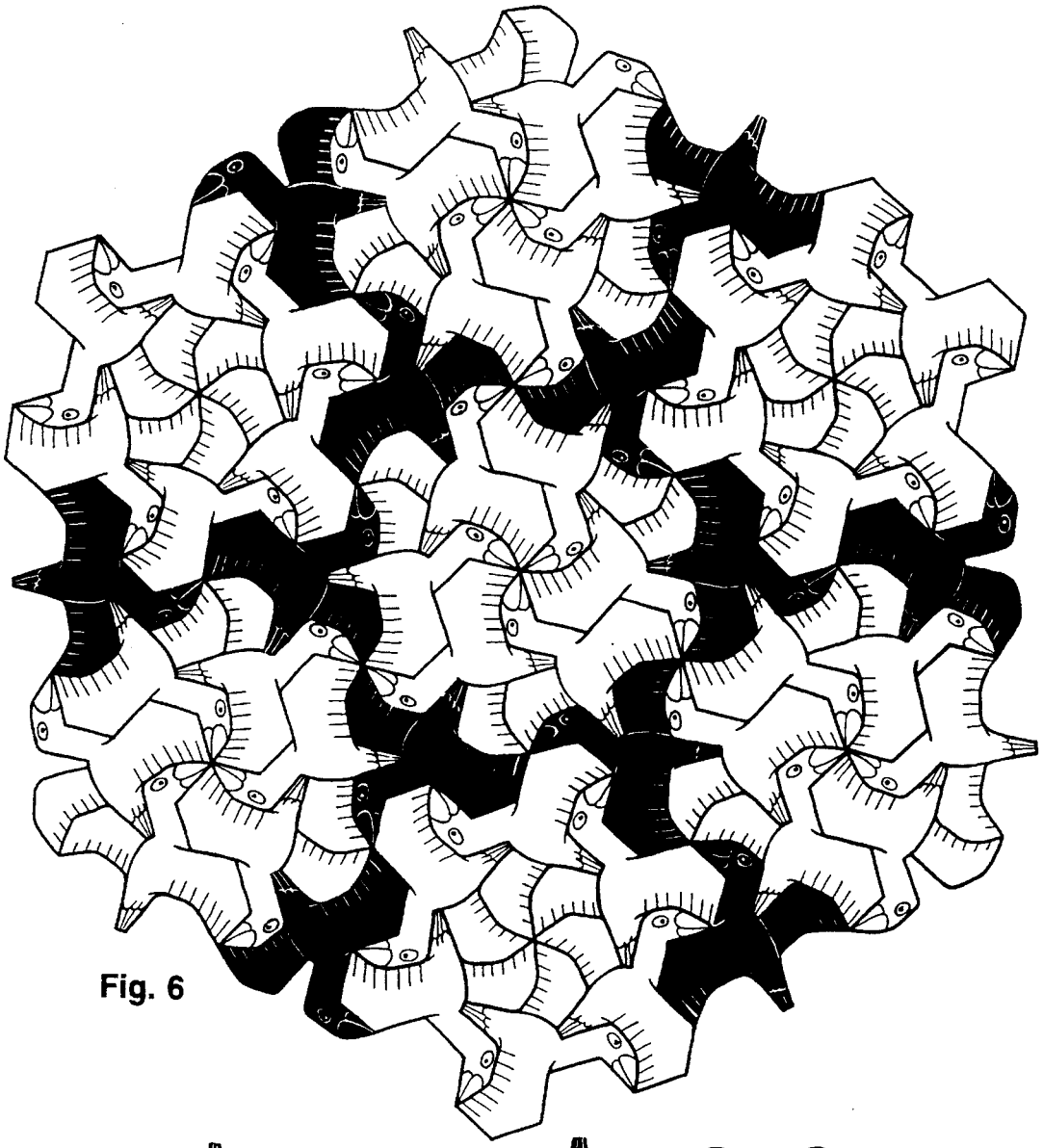
FIG. 6 shows part of a periodic tiling having regular Ozbird tile rosettes.

FIG. 6 shows a patch of a tiling which could be indefinitely extended. Seven Ozbird tile rosettes of two sorts, each composed of right-flying Ozbird tiles, are incorporated in the patch shown. Right-flying or right-circling Ozbirds tiles are white, while the mirror-image left-flying or left-circling Ozbirds are black. Each of the seven white rosettes of six Ozbird tiles could be flipped over as a unit without disturbing the rest of the tiling, in which case the tiling would be all black. Its obverse would then be all white. It may seem puzzling, then, that the arrangement as shown seems to require the black shapes.

If only the three white rosettes that have angular snowflake-like outlines are flipped over, then all tiles in the design will have their sigmoid sides mated with the sigmoid sides of other tiles. Each such pair of sigmoid-side-mated tiles might then be thought of as a single tile based on a 60 degree/120 degree rhombus. The underlying geometry of the assembly would then be akin to that of the first tiling described by Roger Penrose in his essay "Escher and the Visual Representation of Mathematical Ideas" in *M. C. Escher Art and Science*, North-Holland, 1986, H. S. M. Coxeter et al. eds. pages 143–157.

Figure 7:
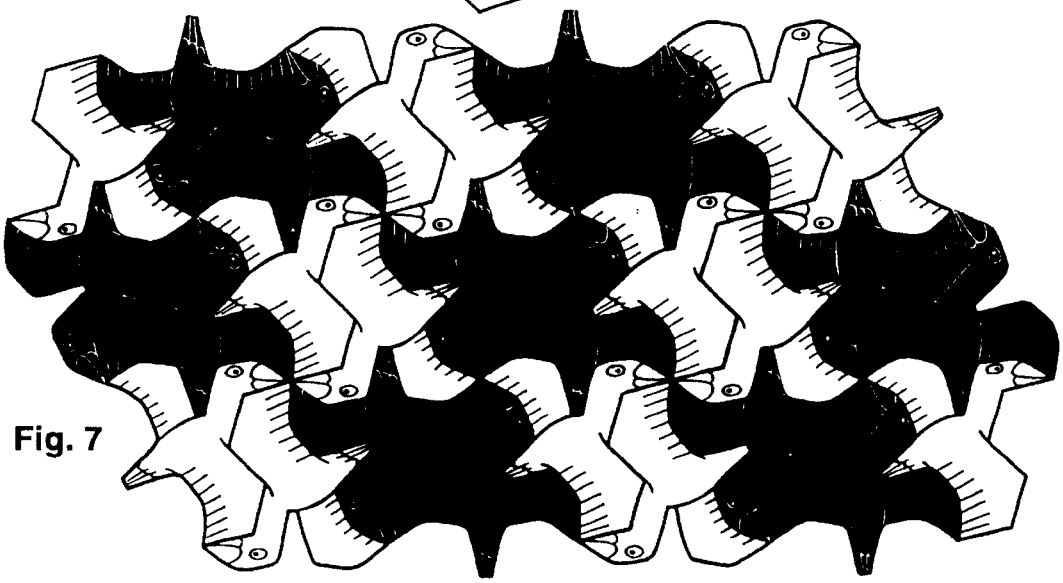
FIG. 7 shows part of another periodic tiling by pairs of Ozbird tiles.

FIG. 7 shows a simple periodic tiling by pairs of left-facing and pairs of right-facing Ozbird tiles.

Figure 8:
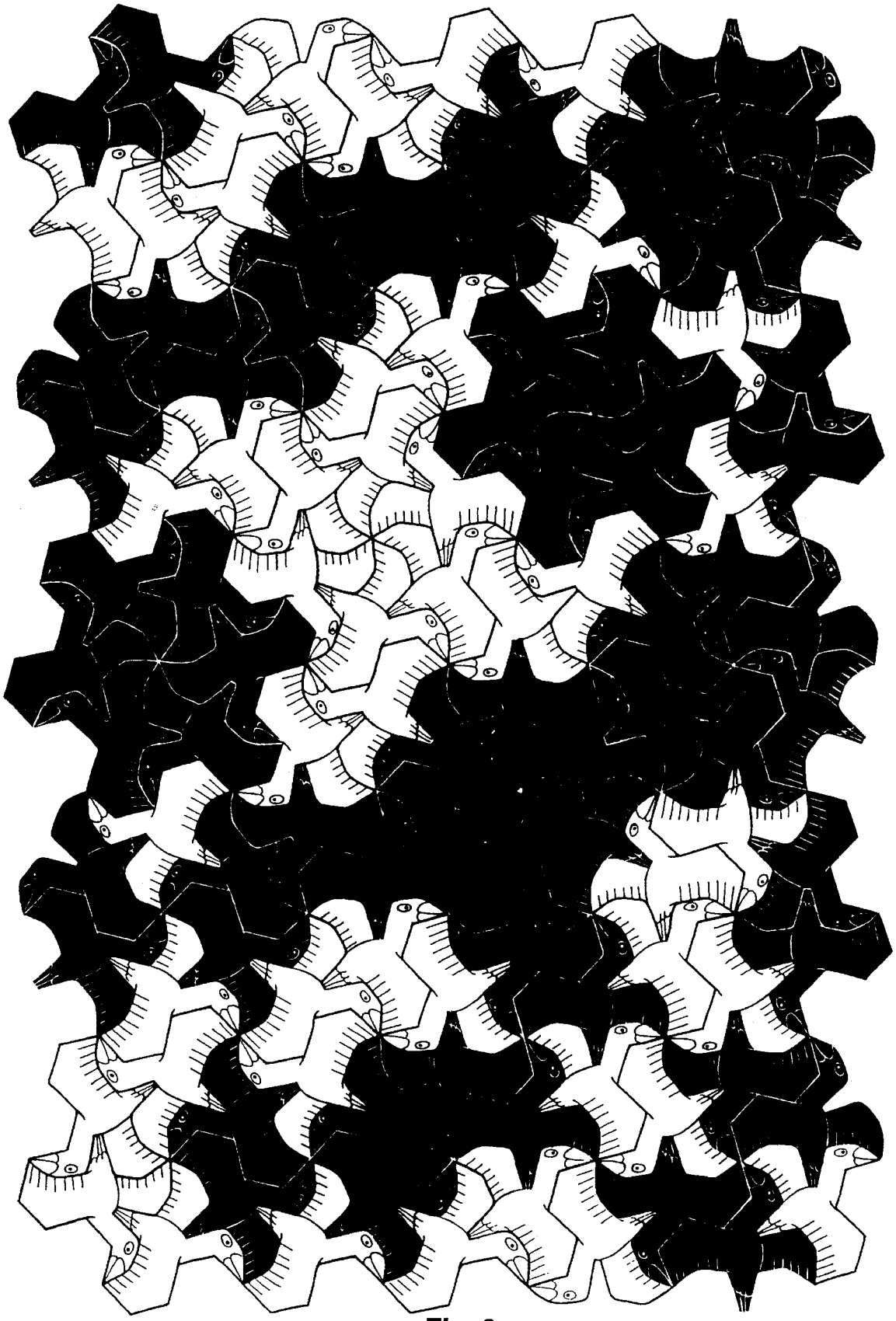
FIG. 8 shows a non-periodic patch of Ozbird tiles.

FIG. 8 shows a non-periodic tiled patch which includes some of the patterns seen in FIGS. 6 and 7. Here again, left-flying Ozbird tiles are black, and right-flying ones are white. This patch is intentionally rather chaotic appearing, but any of the design elements seen here, and an indefinitely large number of others, can be arranged to repeat with pleasing regularity in an infinitude of different over-all patterns.

SUMMARY, RAMIFICATIONS, AND SCOPE

My invention comprises zoomorphic triangle-derived single shapes which will, with duplicates and their mirror images, tile the plane in an indefinite number of different ways. These tiles can also form tilings of the plane in conjunction with all other differently shaped embodiments of this invention, since all share an aspect of their geometry which enables this, namely the sigmoid sides composed of five straight line segments.

There are many possible embodiments which are intermediate between the embodiments shown in FIG. 2A, FIG. 2B, and the preferred embodiment shown in the other drawing figures. Others can be devised by extrapolating beyond them. In view of this fact, and of the fact that all possible embodiments will work together and can be conjoined in a tiling and are therefore in a sense the same, the examples, embodiments and other specificities herein should not be construed as limitations on the scope of the invention. That scope should be determined by the claim.

I claim:

1. Variably assemblable figurative tiles derived from an ancestral equilateral triangle by replacing a first side of said triangle with a point symmetric and generally S shaped, or sigmoid, arrangement of five straight line segments of equal length joined to one another at angles of 120 degrees and, replacing a second side of said triangle with an amphographic line which is line symmetric with reference to the perpendicular bisector of said second side and, replacing the third side of said triangle with a duplicate of said amphographic and line symmetric line, the duplicate being moved into position by rotation in the plane around the vertex common to the second and third sides, these amphographic replacement second and third sides being devised so that they do not interfere with the generally S shaped, or sigmoid, side, nor with one another, either by touching at a point or by crossing.

* * * * *